United States Patent [19]

Bacquie et al.

[11] 3,937,597

[45] Feb. 10, 1976

[54] PRESSURIZED FLUID FEED APPARATUS

[75] Inventors: Serge B. Bacquie, La Croix Saint Ouen; Jean-François M. Cheylus, Compiegne, both of France

[73] Assignee: Poclain, Le Plessis Belleville, France

[22] Filed: Oct. 3, 1974

[21] Appl. No.: 511,822

[30] Foreign Application Priority Data

Oct. 3, 1973 France ..... 73.35395

[52] U.S. Cl. ..... 417/216; 417/15

[51] Int. Cl.[2] ..... F04B 49/00; F04B 1/26

[58] Field of Search ..... 60/423, 431, 449; 417/15, 417/216, 218, 222

[56] References Cited

UNITED STATES PATENTS

| | | | |
|---|---|---|---|
| 2,629,982 | 3/1953 | Hooker | 417/216 |
| 2,664,152 | 12/1953 | Davies | 417/222 |
| 3,225,618 | 12/1965 | Page | 60/431 |
| 3,284,999 | 11/1966 | Lense | 60/431 |
| 3,572,213 | 3/1971 | Laurk | 60/449 |
| 3,609,964 | 10/1971 | Robald | 417/15 |
| 3,732,036 | 5/1973 | Busby | 417/222 |
| 3,788,063 | 1/1974 | Kempson | 60/449 |
| 3,841,795 | 10/1974 | Ferre et al. | 417/423 |
| 3,859,790 | 1/1975 | Bacquie et al. | 60/423 |

*Primary Examiner*—William L. Freeh
*Attorney, Agent, or Firm*—Mason, Fenwick & Lawrence

[57] ABSTRACT

This invention relates to an apparatus for feeding pressurized fluid by a constant c. c. pump and a variable c. c. pump, both driven by a single motor.

A valve actuated by a centrifugal governor ensures the feed of a jack adjusting the position of the member for adjusting the cubic capacity of the variable c. c. pump.

One application is the drive of pumps of which the sum of the maximum powers is greater than the maximum power of the motor.

14 Claims, 5 Drawing Figures

PRESSURIZED FLUID FEED APPARATUS

Figure 1:
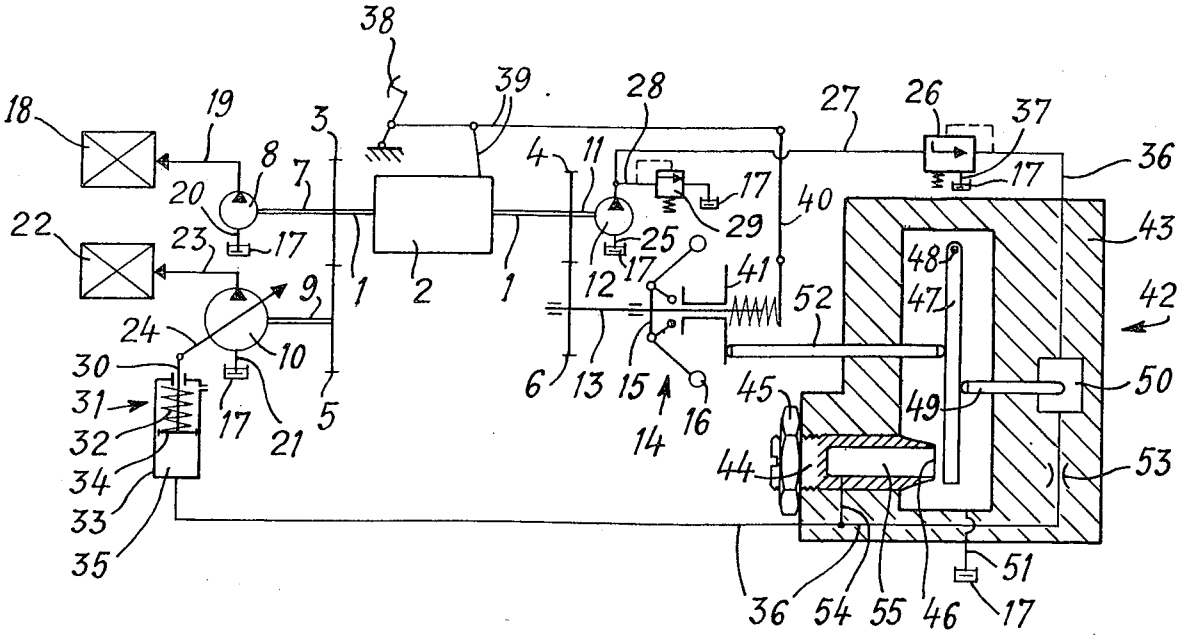

The present invention relates to an apparatus for feeding pressurized fluid, comprising a motor for driving pumps of limited power.

Pressurized fluid feed apparatus are known in which the motor driving the pumps has a maximum power which is lower than the sum of the maximum powers of the pumps that it drives. In view of the fact that, in such devices, certain of the pumps are of the type whose cubic capacity is variable, whilst certain others are of the type with constant cubic capacity and feed priority load circuits, functioning has heretofore been made possible by providing the variable c. c. pumps with improved flow governors.

However, it has been ascertained that such governors were complicated and expensive and were a restraint, difficult to tolerate, on the use of the above-mentioned feed apparatus.

It is to remedy these drawbacks that the invention proposes a new pressurized fluid feed apparatus constituted by:

a fluid tank,
at least one constant c. c. pump,
at least one variable c. c. pump,
a motor for driving said pumps, of which the maximum power is lower than the sum of the maximum drive powers of these pumps,
and a device for regulating the total drive power of the pumps to a value at the most equal to the maximum power of the motor, itself constituted by:
a governor whose action is a function of the speed of rotation of the motor, and which is coupled to the driven shaft of said motor,
a source of piloting fluid at constant pressure,
a control motor having a movable output member coupled to the c. c. control member of at least one of the variable c. c. pumps, and which comprises a drive chamber connected to the source of piloting fluid by a piloting conduit,
and a valve comprising a valve body.

This valve comprises, in addition, a nozzle fed in shunt with piloting fluid, a member for selectively closing the outlet aperture of said nozzle, which is mounted to move in the valve body and which is disposed opposite said outlet aperture, a member for returning said closing member in position in the sense corresponding to the closure of the nozzle, and a conduit for returning the fluid contained in the valve body to the tank.

The outlet member of the governor is coupled to the valve-closing member so that there corresponds to its displacement corresponding to a reduction in the speed of rotation of the motor, a variation in the section of the passage made between the closure member and the nozzle, which brings about a variation in the pressure of the fluid feeding said jack and consequently the displacements of the mobile member of this jack and the c. c. control member which is connected thereto in the sense of a raduction of the corresponding cubic capacity.

A restriction is advantageously disposed in the piloting conduit between the source of piloting fluid and the feed pipe for the nozzle.

According to a first embodiment, the governor is a centrifugal governor of the inertia-block type. Thus, the drive motor being an internal combustion engine (of the "Diesel" type) and comprising a speed regulator, the governor of the supply device is constituted by said speed regulator itself.

According to another embodiment, the governor is constituted by:

a volumetric pump connected to the driven shaft of the drive motor;
a control member having a movable output member connected to the closure member and which possesses a drive chamber connected to the volumetric pump by the delivery conduit of this pump;
branch pipe tapped to said delivery conduit and connected to the tank,
and a restriction disposed in said branch pipe.

Furthermore, the position of the nozzle is preferably adjustable in the body of the valve, and its position may even be dependent on the value of the delivery pressure of the or each constant flow pump.

In this latter case, the nozzle is, for example, mounted to slide in the valve body and is coupled to the piston rod of a hydraulic cylinder for adjusting its position, which hydraulic cylinder has a drive chamber connected by a connecting conduit to the delivery conduit of the or each constant c. c. pump.

According to a first variant embodiment, the closing member is constituted by a plate mounted to pivot on the valve body. In this case, the member returning the closing member is advantageously constituted by the piston rod of a hydraulic cylinder, of which the drive chamber is fed by the piloting fluid.

According to a second variant embodiment, the closing member is mounted to slide in the valve body and is disposed opposite the outlet aperture of the nozzle. In this case, the closing member preferably comprises an element mounted to slide on the outlet member of the governor, whilst an elastic member is interposed between said element and said outlet member and has the effect of thrusting this element towards the outlet aperture of the nozzle.

It should also be indicated that the invention, in its main gist, is more generally applied to the case of the motor driving, not a constant c. c. pump, but a receiver with non-adjustable drive power. Thus, one application is the drive of variable c. c. pumps, certain of these pumps being able to be regulated at constant power, at least one of them being regulated by means of the piston rod of a hydraulic cylinder or control motor of the regulation device proposed by the present invention.

Figure 2:
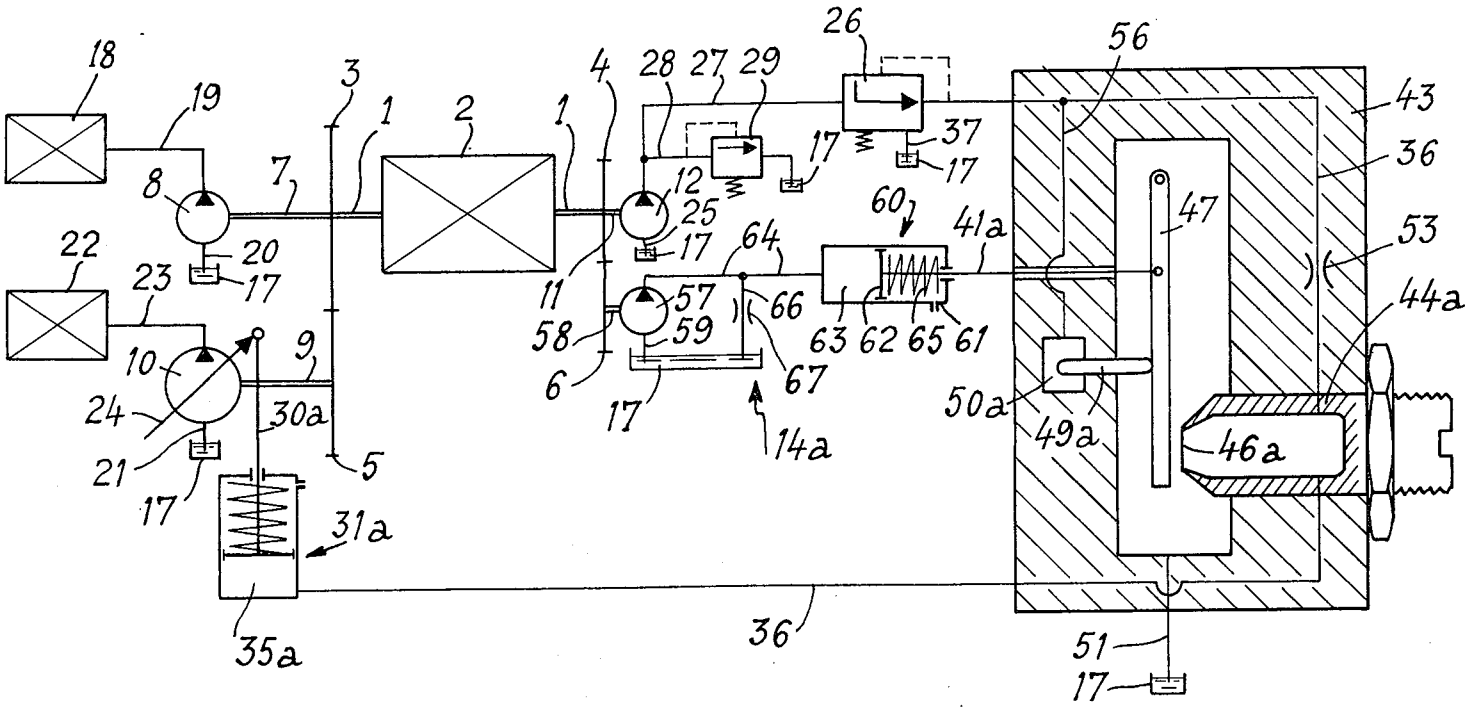
Figure 3:
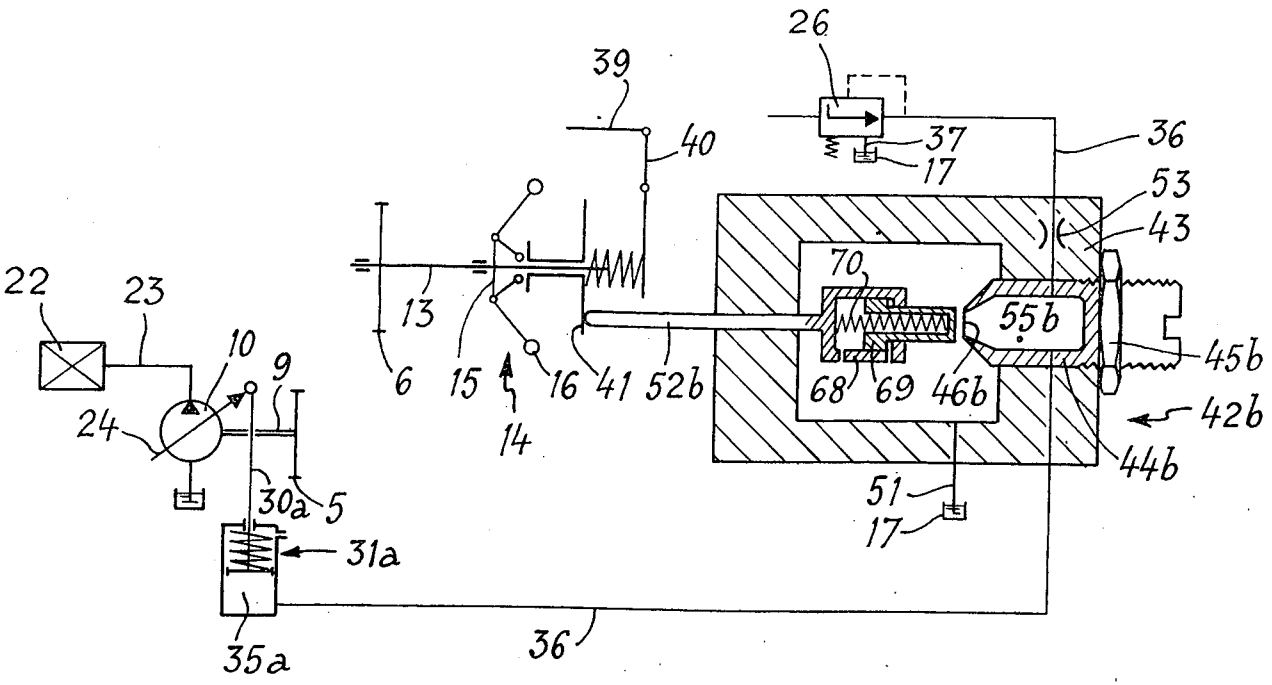
Figure 4:
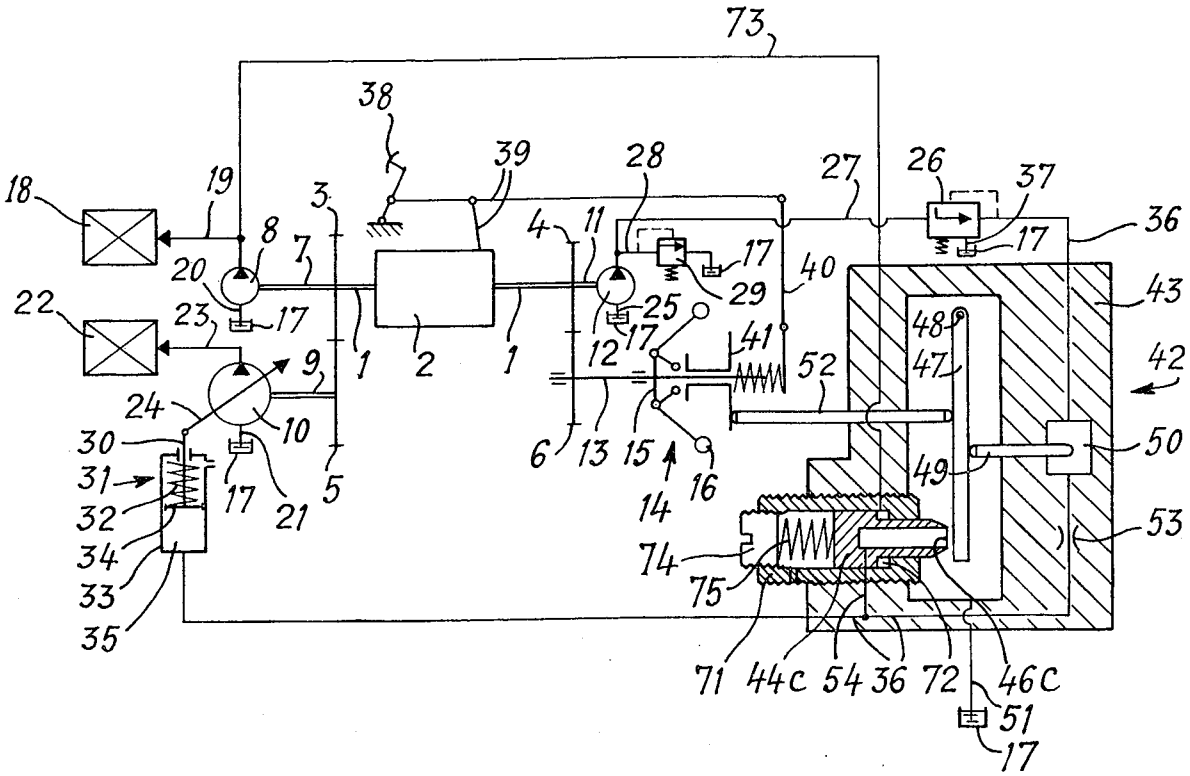
Figure 5:
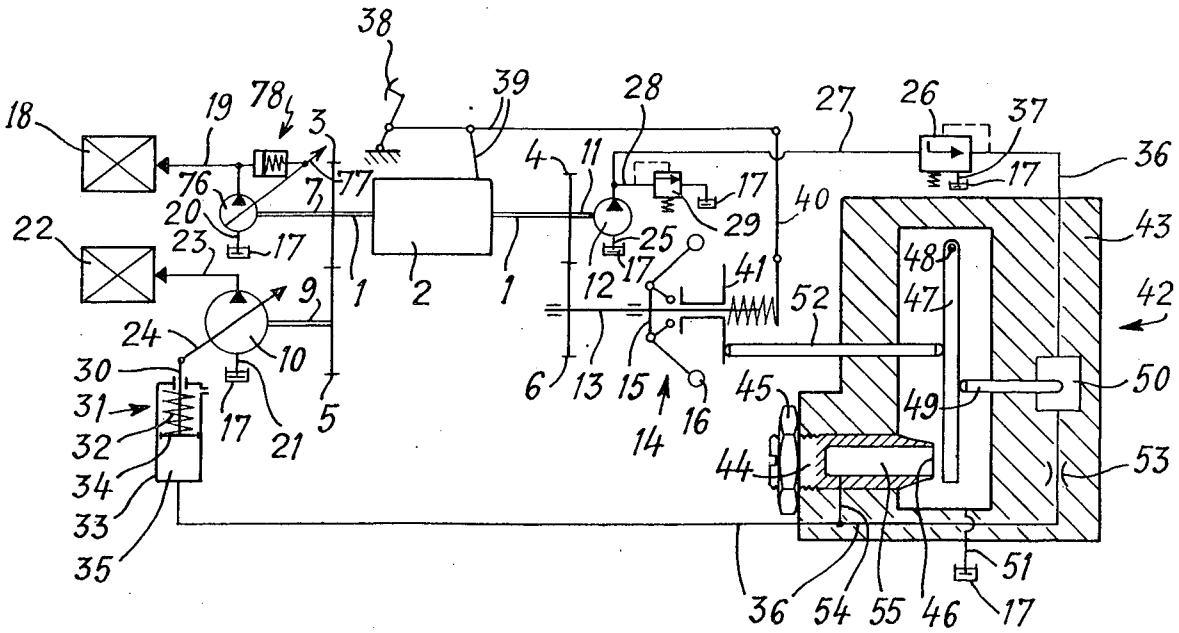

The invention will be more readily understood on reading the following description and with reference to the accompanying drawings, in which:

FIG. 1 schematically shows a first embodiment of the apparatus in accordance with the invention, FIGS. 2 and 3 are diagrams showing second and third variant embodiments respectively according to the invention, FIG. 4 schematically shows a fourth improved variant embodiment of a feed apparatus in accordance with the invention, FIG. 5 schematically shows a fifth variant embodiment, very similar to that of FIG. 1, but differing therefrom by the features of the elements driven by the motor.

Referring now to the drawings, FIG. 1 shows a diagram in which toothed pinions 3 and 4, which mesh with pinions 5 and 6 respectively, rotate with the driven shaft 1 of a motor 2 of the "Diesel" type. The drive shaft 7 of a main pump 8 with constant c. c. rotates with the pinion 3, whilst the drive shaft 9 of a main pump 10 with variable c. c. rotates with pinion 5. The drive shaft 11 of an auxiliary pump 12, with constant c. c., rotates with the pinion 4, whilst the drive shaft 13 of a governor 14 with inertia blocks itself rotates with pinion 6, the plate 15 comprising the inertia blocks 16 of the governor 14 itself being fast with shaft 13.

It will be noted that the pump 8 is connected to a fluid tank 17 via its suction conduit 20 and to a first load circuit 18 via its delivery conduit 19. The pump 10 is connected to the tank 17 via its suction conduit 21 and to a second load circuit 22 via its delivery conduit 23. Furthermore, this pump 10 comprises a pump output control member 24 for adjusting the value of its cubic capacity, which is constituted, for example, by an inclinable plate in the case of a pump with axial pistons. The pump 12 is connected to the tank 17 via its suction conduit 25 and to a valve 26 via its delivery conduit 27. A discharge conduit 28 is tapped, in manner known per se, to the delivery conduit 27 which it connects to the tank 17, a calibrated discharge valve 29 being disposed in this conduit 28.

It is noted that the piston rod 30 of a control motor in the form of a hydraulic cylinder and piston assembly 31 is coupled to the pump output control or regulating member 24, a spring 32 being interposed between the cylinder 33 and the piston 34 of the control motor 31, and having a thrust effect on the piston, in such a sense that the corresponding displacement of the regulating member 24 brings about an increase in the cubic capacity and thus in the flow of pump 10. The control motor 31 has a drive chamber 35 which is connected to the output of the valve 26 which comprises a source of piloting fluid via a so-called piloting conduit 36. The effect of the pressure of the fluid contained in the chamber 35 on the piston 34 is antagonistic to that of the spring 32.

As regards the valve 26 which is, moreover, known, its opening is controlled by the pressure of the fluid contained downstream in the conduit 36. When this pressure rises, this control causes a reduction in the section of passage of the valve and vice versa. This valve 26, connected to tank 17 via a return conduit 37, therefore maintains the pressure of the fluid contained in a first part of the conduit 36, comprised between said valve 26 and a restriction 53 disposed between the valve 26 and the chamber 35, substantially constant. For this reason, the valve 26 is referred to as being a constant pressure valve.

The existence of the pedal 38 of an accelerator, of the linkage 39 for controlling the feed of fuel to motor 2, and of the linkage 40 for controlling the initial position of the inertia blocks 16 of the governor 14, will also be noted. Of course, the "Diesel" engine 2 itself having a governor with inertia blocks for regulating its speed of rotation, the governor 14 may perfectly well be constituted by this speed regulator itself. The outlet member of the governor 14 is constituted by a ring 41.

Finally, a valve 42 is disposed in conduit 36. It is constituted by:

- a body 43,
- a nozzle 44 maintained in position in the body 43 by a lock-nut 45 and having an outlet aperture 46,
- a movable closure member comprising a plate 47 mounted to pivot in the body 43 about an axis 48 having its free end disposed opposite the outlet aperture 46 of the nozzle,
- a rod 49, forming piston, which is disposed on the side of the plate 47 opposite that where the aperture 46 is located and which opens out into a chamber 50, arranged in the body 43 through which the piloting conduit 36 passes,
- and a return conduit 51 to the tank 17 from the inside of the body 43,
- a connecting rod 52 is mounted to slide in the body 43 and is in contact, with the output member 41 of the regulator 14 and with the plate 47, on the side of the nozzle 44. It is further noted that the restriction 53 is disposed in conduit 36 between chambers 50 and 35 and that a shunt conduit 54, tapped to conduit 36 downstream of the restriction 53 with respect to the valve 26, connects this conduit 36 to the inside 55 of the nozzle 44.

FIG. 2 shows a variant embodiment which for a large part repeats the embodiment of FIG. 1. The unchanged elements have the same reference numerals in both cases. Two particularities, which are new with respect to FIG. 1, are to be noted.

Firstly, the nozzle has come to **44*a* on the side opposite the output member 41*a* of the governor 14*a* with respect to the plate 47. The rod 49*a* forming piston is disposed on the same side of the plate 47 as the member 41*a*. The reversal of the position of the nozzle 44*a* and of its output aperture 46*a* with respect to plate 47 has also led to reversing the position of coupling of the output member of the control motor to the member 24 adjusting the cubic capacity of the pump 10. The control member 31*a* has its drive chamber 35*a* connected to conduit 36 and its rod 30*a* coupled to the adjusting member 24. The chamber 50*a* of the piston rod 49*a* is moreover connected to conduit 36 via a conduit 56**.

It will further be noted that the governor **14*a* is no longer constituted by an inertia block governor. This governor 14*a*** is constituted by:

- a volumetric pump 57 of which the drive shaft 58 rotates with the pinion 6 which is connected by its suction conduit 59 to the tank 17.
- a regulating control motor in the form of a hydraulic cylinder 60, constituted by a cylinder 61, a piston 62, the piston rod **41*a* and comprising a drive chamber 63 connected to the delivery conduit 64 of the pump 57, as well as a spring 65 interposed between the cylinder 61 and the piston 62 and having an effect antagonistic to that of the fluid contained in the chamber 63; this effect of the spring 65 tending to separate the plate 47 from the outlet aperture 46*a* of the nozzle 44*a***.
- a conduit 66, tapped to the delivery conduit 64 and connecting this conduit 64 to the tank 17,
- finally, a restriction 67, disposed in the return conduit 66.

FIG. 3 takes up the disposition of FIG. 1 to present a variant embodiment thereof concerning the valve 42. All the elements of FIG. 1 are therefore taken up again and are given the same references, except valve **42*b* which is new and control motor 31*a*, which is coupled to the member 24, in similar manner to the control motor 31*a* of FIG. 2. A nozzle 44*b* is fixed to the body 43 by a lock-nut 45*b* and comprises an outlet aperture 46*b*. A cylinder 68 is fast with a connecting rod 52*b* which abuts on the ring 41 of the governor 14. A piston 69 is mounted to slide in the cylinder 68 and is disposed opposite the outlet aperture 46*b* of the nozzle. A spring 70 is interposed between the piston 69 and the cylinder 68 and has for its effect to create a thrust on the piston 69 tending to displace this piston in the sense provoking the closure of the outlet aperture 46*b***. The conduit 36 passes through the inside 55*b* of the nozzle 44 *b* which it feeds with fluid.

FIG. 4 repeats the disposition of FIG. 1 with the sole exception of the constitution and assembly of the nozzle of the valve 42. The nozzle is now shown at 44*c*, its outlet aperture 46*c* still disposed opposite the plate 47. It is mounted to slide in a cylinder 71 and in fact constitutes a piston for this cylinder. It defines inside the cylinder 71 a chamber 72 which is connected, by a conduit 73, to the delivery conduit 19 of the main constant c. c. pump 8. A plug 74, screwed in the body of the cylinder 71, compresses a spring 75 interposed between this plug and the nozzle 44*c*. The spring 75 has an effect on the nozzle 44*c* which is antagonistic to that of the pressure of the fluid contained in the chamber 72, the effect of said pressure tending to separate the outlet aperture 46*c* of the nozzle 44*c* from the plate 47. Finally, it is noted that the cylinder 71 is screwed in the body 43 of the valve 42 and is therefore adjustable in position with respect to said body.

Finally, the variant embodiment of FIG. 5 is identical to the embodiment of FIG. 1, except for the substitution for pump 8 of a variable c. c. pump 76, of which the member 77 for adjusting the cubic capacity is coupled to the mobile member of a power governor 78 regulating the drive power of the pump 76 to a constant value.

The functioning of the devices which have been described will now be given, as well as the advantages to be drawn from their adoption.

Concerning the embodiment of FIG. 1, the "Diesel" engine 2 being in operation, the driver adjusts the pedal 38 to a given position, to which corresponds the determined position of the speed governor of the engine 2 and therefore a well defined speed of rotation of this engine 2.

It is recalled that the maximum power of the motor 2 is lower than the sum of the maximum powers of the pumps 8 and 10. For example, powers equal to 100, 60 and 100 h. p. respectively are found. Furthermore, it is admitted that the load circuit 18 must have priority pressure feed and with desired flow, but that on the contrary the circuit 22 may be supplied only with a flow lower than the normally necessary flow, for short periods.

As long as the sum of the powers necessary for driving the pumps 8 and 10 (and of auxiliary pump 12 and governor 14) is lower than the maximum power of the motor 2 corresponding to the chosen speed of rotation, said engine 2 is obviously sufficiently powerful to drive said pumps without difficulty.

If it then happens that the load circuit must be fed at a higher pressure and that these circumstances result in such a rise in the power necessary for driving the pump 8, that the sum of the powers driving the pumps 8 and 10 becomes greater than the power of the engine 2, said latter risks stopping because it cannot overcome too high a drive resistance. It is then that the new device proposed by the invention acts to avoid the engine 2 stopping.

As soon as the maximum power of the engine 2 becomes lower than the sum of the drive powers of the pumps 8 and 10, the value of the speed of rotation of this motor drops. The inertia blocks 16 of the governor 14 move close to the shaft 13, this bringing about a relative separation of the ring 41 from valve 42. The plate 47, under the effect of the rod 49, and in view of the slight backward movement of the rod 52, pivots about the shaft 48 and moves close to the outlet aperture 46 of the nozzle 44. Consequently, the feed fluid of the chamber 35 of the control motor 31, which was under a certain pressure, lower than the constant pressure of the fluid at the immediate outlet of the valve 26, undergoes a rise in pressure, the passage made between the plate 47 and the aperture 46 through which this fluid returned to the tank 17, via conduit 51, having undergone a narrowing of its section. The piston 34 then moves the rod 30 and the member 24 adjusting the cubic capacity, in the sense causing a reduction in the delivery flow of the pump 10 and consequently in the sense of a reduction in the power necessary for driving said pump 10. As long as the speed of rotation of the engine 2 has not taken its initial value of adjustment, the inertia blocks 16 do not take up their initial position again. Consequently, the plate 47 continues to close the aperture 46 (at least partially) so that a high pressure is maintained in the chamber 35. The member 24 adjusting the cubic capacity is consequently displaced until the corresponding reduction of cubic capacity and thus of the flow of the pump 10, be sufficient for the reduction of the power necessary for driving this pump 10 to have allowed the sum of the powers driving the pumps 8 and 10 to return to a value slightly lower than the maximum power of the engine 2. This engine may, under these conditions, find its initial speed again.

It is therefore ascertained that the desired feeds have been able to be effected very simply, in view, of course, of the momentary restriction admitted of the feed flow of circuit 22.

Whilst, in the earlier devices, the member 24 adjusting the cubic capacity of the pump 10 was constituted by a power governor, which comprised precisely calibrated springs, contained in the body of the corresponding pump, and of which the calibration corresponded to a single maximum drive power of this pump, this necessitating as many different governors as different powers desired, the adjustment is effected very simply in the device proposed in the present Application, by taking from the "Diesel" engine 2 itself the information concerning its speed of rotation.

To the position of the nozzle 44 in the body 43 there corresponds a correlative position of rod 52 and consequently of ring 41. This position of the nozzle 44 therefore defines a value of adjustment of the speed of rotation, from which the governor 14 acts on the rod 52.

In the embodiment of FIG. 1, the adjustment of the drive power of the pump 10 is ensured by the compression of the fluid of the part of the conduit 36 included between the restriction 53 and the chamber 35, said compression being brought about by the plate 47 pivoting and coming close to the aperture 46.

It is readily understood that, from this point of view, the embodiment of FIG. 2 operates similarly to that of FIG. 1 except that a drop in the value of the speed of rotation of the engine 2 causes the rod 41*a* to move backwards with respect to the nozzle 44*a*, as will be seen later, due to an increase in the passage made between the aperture 46*a* and the plate 47, and consequently a decompression of fluid in the part of the conduit 36 included between the restriction 53 and the chamber 35*a*, similar to chamber 35. For the effect on the member 24 regulating the cubic capacity of the pump 10 to be, despite everything in accordance with the sought after solution, it has been necessary to reverse the connection of the rod 30*a* of the control motor 31*a* to the member 24, so that the reduction in the cubic capacity of the pump 10, which was caused, in the embodiment of FIG. 1, by an increase in the pressure in the chamber 35, is now caused by a reduction in the pressure in chamber 35*a*.

As regards the governor 14*a*, it is understood that all it does is transmit to the plate 47 the information concerning the variation in the speed or rotation of the engine 2. In fact, in normal working conditions, the pressure in the chamber 63 is constant, the flow delivered by the volumetric pump 57 for a given speed of the engine 2 flowing towards tank 17 through restriction 67, which maintains in the conduit 64 a given pressure, of which the effect on the piston 62 produces a well-determined compression of the spring 65, and to which a single, well defined position of the rod 41*a* therefore corresponds. However, when the speed of rotation of the engine 2 drops, the flow of the volumetric pump 57 also reduces. The pressure maintained in the conduit 64 by the restriction 67 diminishes this bringing about the abovementioned separation of the rod 41*a* with respect to the nozzle 44*a*.

The governors 14 and 14*a*, as has just been seen, are of the type whose action is a function of the speed of rotation of the engine 2. This engine, which has been mentioned in the example described as being of the "Diesel" type, may of course be of any other type.

In the embodiment of FIG. 3, the plate has been eliminated and replaced by an equivalent constituted by the end of the piston 69. It is now the spring 70 which fulfills the function of returning the piston 69 towards aperture 46*b*, this function being fulfilled, in the embodiment of FIGS. 1 and 2, by rods 49 or 49*a* for returning the plate 47. The other characteristics of functioning remain unchanged with respect to those, in particular, of the embodiment of FIG. 2 and have therefore not been described again.

Finally, the embodiment of FIG. 4 is characteristic, firstly, by the complete taking up the means of FIG. 1.

For a given pressure of the fluid contained in the delivery conduit 19 of the pump 8, the pressure in the conduit 73 and in chamber 72 has a well defined position which is constant with respect to the body 43 of the valve 42 for which the antagonistic effects of the spring 75 and the pressure of the fluid in the chamber 72 are balanced. Consequently, the nozzle 44*c* is disposed in exactly the same way as the nozzle 44 of FIG. 1. It is deduced therefrom that all the means of the embodiment of FIG. 1 having been taken up, all the functioning obtained by adoption of the embodiment of FIG. 1 is again obtained by adoption of the embodiment of FIG. 4.

However, the embodiment of FIG. 4 comprises in addition an adjustment of the position of nozzle 44*c*, which is dependent on the value of the delivery pressure of the pump 8. Starting from a configuration from which the drive power of the pump 8 decreases (just as the pressure of the fluid of conduit 19 decreases), it is ascertained that the spring 75 moves the nozzle 44*c* towards the plate 47, this bringing about a displacement of the member 14 for adjusting the flow of the pump 10 in the sense of a reduction of this flow. This disposition is advantageous, when the maximum power of the engine 2 is greater than the maximum drive power of the pump 10. In such a case, if the drive power of the pump 8 drops sufficiently for the engine 2 to have an excess of power available with respect to the maximum drive power of the pump 10, it should be avoided that this excess of power be used for driving this pump 10 and causes the deterioration of said pump. This is the case, for example, where the maximum powers of the pumps 8, 10 and of engine 2 have values of 60, 100 and 130 h. p. It should then be avoided to drive the pump 10 at more than 100 h. p. even if the engine 2 has an available power greater than 100 h. p.

The displacement of the nozzle 44*c* has brought about a reduction of the cubic capacity, thus of the delivery flow of the pump 10, and has therefore effected a sort of initial substraction of the excess power which the engine 2 has with respect to pump 10, so that the pump 10 no longer risks being driven at too great a power for its own characteristics.

Of course, the above description having shown that the very gist of the invention is to be able to drive a pump whose drive power is not adjustable and a pump of adjustable power by a single engine of limited power, it is immediately understood that the invention also covers the case of the pump of non-adjustable power being replaced by any receiver, also of non-adjustable power. Such is the case in particular of a variable c. c. pump 76 (FIG. 5) regulated to constant power by a governor 78.

What we claim is:

1. An apparatus for feeding pressurized fluid constituted by:

a fluid tank, at least one variable c.c. pump having a pump output control member for varying its output, at least one receiver member of which the power necessary for said receiver member to be driven is substantially constant, a motor having an output shaft for driving the variable c.c. pump and the receiver member, the maximum power of said motor being less than the sum of the maximum drive powers of said pump and said receiver members, and a regulation device for regulating the total drive of the pump and the receiver members to a value at the most equal sum to the maximum power of the motor, said regulation device itself being constituted by:

a governor having an input coupled to the output shaft of the motor and having a speed indicating output member positioned as a function of the speed of rotation of the motor, a source of piloting fluid at constant pressure, a piloting conduit connected to said source of piloting fluid, a control motor having a motor output member coupled to the pump output control member for controlling the cubic capacity of said pump and which includes a drive chamber connected to the source of piloting fluid by said piloting conduit:

and a closure valve comprising a valve body, wherein said valve comprises in addition a nozzle having an inlet connected to said source of piloting fluid and an outlet aperture in said valve body, a movable closure member for selectively closing the outlet aperture of said nozzle, said movable closure member being mounted to move in the valve body and disposed opposite said outlet aperture to vary the area thereof, a return member for moving said movable closure member to effect the closure of the nozzle, and a return conduit connected to the interior of said valve body for receiving fluid from said nozzle for returning the fluid to the tank, the speed indicating output member of the governor being coupled to the movable closure member so that displacement of said speed indicating output member corresponding to a reduction in the speed of rotation of the motor causes a variation in the area of the passage between the movable closure member and the nozzle which brings about a variation in the pressure of the fluid feeding said control motor and a consequent displacement of the motor output member and the oump output control member which is connected thereto to effect a reduction in the corresponding cubic capacity of said variable c.c. pump.

2. An apparatus for feeding pressurized fluid, constituted by:

a fluid tank, at least two variable c.c. pumps each having a pump output control member for varying its capacity, a motor having an output shaft for driving said pumps, the maximum power of said motor being less than the sum of the maximum drive power required of said pumps, and a regulation device for regulating the total drive power of the pumps to a value at the most equal to the maximum power of the motor, said regulation device being constituted by:

a governor having an input coupled to the output shaft of said motor and a speed indicating output member positioned as a function of the speed of rotation of the motor, a source of piloting fluid at constant pressure, a piloting conduit connected to said source of piloting fluid, a control motor having a motor output member coupled to the pump output control member of one of said pumps for controlling the cubic capacity of that pump and which includes a drive chamber connected to the source of piloting fluid by said piloting conduit, and a valve comprising a valve body, wherein said valve comprises, in addition, a nozzle having an inlet connected to said source of piloting fluid and an outlet aperture in said valve body, a movable closure member for selectively closing the outlet aperture of said nozzle and which is mounted to move in the valve body in facing relationship to said outlet aperture, a return member for moving said movable closure member toward said output aperture to effect closure of the nozzle, and a return conduit connected to the interior of the valve body to receive fluid from said nozzle to the tank, the speed indicating output member of the governor being coupled to the movable closure member so that its movement corresponding to a reduction in the speed of rotation of the motor causes a variation in the area of the passage between the movable closure member and the nozzle, which brings about a variation in the pressure of the fluid feeding said control motor and a consequent displacement of the motor output member and the pump output control member connected thereto for effecting a reduction of the corresponding cubic capacity of said pump.

3. An apparatus for feeding pressurized fluid constituted by:

a fluid tank, at least one constant c.c. pump, at least one variable c.c. pump having a pump output control member for varying its capacity, a motor having an output shaft for driving said constant c.c. and variable c.c. pumps, the maximum power of said motor being less than the sum of the maximum drive powers of said pumps, and a control device for regulating the total drive power of the pumps to a value at the most equal to the maximum power of the motor, constituted by:

a governor whose action is a function of the speed of rotation of the motor and which is coupled to the driven shaft of said motor, said governor having a speed indicating output member positioned in accordance with the speed of said motor, a source of piloting fluid at constant pressure, a control motor having a motor output member coupled at least to the control member for controlling the cubic capacity of at least one of the variable c.c. pumps and which control motor includes a drive chamber connected to the source of piloting fluid by a piloting conduit, a shunt conduit connected on one end to said sou of piloting fluid, and a closure valve comprising a valve body, wherein said closure valve comprises, in addition, a nozzle having an outlet aperture in said valve body and an inlet connected to said shunt conduit to receive piloting fluid, a movable closure member for selectively closing the outlet aperture of said nozzle, said movable member being mounted to move in the valve body and being disposed opposite said outlet aperture, a return member for moving said closure member toward said nozzle to effect the closure of the nozzle, and a return conduit connected to the interior of said valve body for receiving fluid from said nozzle for returning fluid contained in the valve body to the tank, the speed indicating output member of the governor being coupled to the movable closure member so that displacement of said speed indicating output member corresponding to a reduction in the speed of rotation of the motor effects a variation in the area of the passage between the movable closure member and the outlet aperture of the nozzle which brings about a variation in the pressure of the fluid in said drive chamber of said motor and a consequent displacement of the motor output member and the control member of said variable c.c. pump which is connected thereto to effect a reduction of the corresponding cubic capacity of said variable c.c. pump.

4. An apparatus as claimed in claim 3, wherein the governor is constituted by:

a volumetric pump having a delivery conduit and drivingly connected to the output shaft of the drive motor, a regulating hydraulic cylinder having a piston and coupled to the movable closure member and which includes a drive chamber connected to the volumetric pump by the delivery conduit of this pump.

a branch pipe tapped to said delivery conduit and connected to the tank, and a restriction disposed in said branch pipe.

5. An apparatus as claimed in claim 3 wherein the movable closure member is constituted by a plate mounted to pivot in the valve body.

6. An apparatus as claimed in claim 3 wherein the return member for moving the closing member comprises a piston rod of a hydraulic cylinder having a drive chamber connected to the source of piloting fluid.

7. An apparatus as claimed in claim 3 additionally including a restriction disposed in the piloting conduit between the source of piloting fluid and the connection of said shunt conduit to the nozzle.

8. An apparatus as claimed in claim 7, wherein the governor is a centrifugal governor of the type having inertia blocks.

9. An apparatus as claimed in claim 8, wherein the drive motor is a diesel engine and said governor comprises a speed regulator connected to said motor.

10. An apparatus as claimed in claim 3, wherein the position of the nozzle is adjustable in the valve body.

11. An apparatus as claimed in claim 10 including means for adjusting the position of the nozzle in accordance with the delivery pressure of the constant c.c. pump.

12. An apparatus as claimed in claim 11, wherein the nozzle is mounted to slide in the valve body and is coupled to a nozzle adjusting piston rod of a hydraulic cylinder for adjusting its position, said last-mentioned hydraulic cylinder having a drive chamber connected to the pump output of the constant c.c. pump.

13. An apparatus as claimed in claim 3 wherein the movable closure member is mounted to slide in the valve body and is disposed opposite the outlet aperture of the nozzle.

14. An apparatus as claimed in claim 13 wherein the movable closure member is mounted to be moved by the speed indicating output member of the governor, and additionally including an elastic member interposed between said movable closure member and said speed indicating output member and has the effect of thrusting the movable closure member towards the outlet aperture of the nozzle.

* * * * *